US005546835A

United States Patent [19]

Seile

[11] Patent Number: 5,546,835

[45] Date of Patent: Aug. 20, 1996

[54] FLEXIBLE HOSE JOINING TOOL

[76] Inventor: John A. Seile, 1128 SW. 28th St., Palm City, Fla. 34990

[21] Appl. No.: 274,301

[22] Filed: Jul. 11, 1994

[51] Int. Cl.[6] ..... B25B 7/02

[52] U.S. Cl. ..... 81/426.5; 81/419; 81/420; 81/9.3

[58] Field of Search ..... 81/426.5, 424.5, 81/419, 420, 9.3, 485, 486; 29/235, 238, 268, 270, 271, 272, 278, 280, 282

[56] References Cited

U.S. PATENT DOCUMENTS

| | | | |
|---|---|---|---|
| 790,500 | 5/1905 | Harper | 81/419 X |
| 1,069,106 | 8/1913 | Brice | 81/426.5 X |
| 3,585,703 | 6/1971 | Goss | 29/237 |
| 3,952,619 | 4/1976 | Cook | 81/426.5 X |
| 4,054,984 | 10/1977 | Ball et al. | 29/237 |
| 4,219,919 | 9/1980 | Fischbein et al. | 81/424.5 X |
| 4,934,171 | 6/1990 | Konetzke, Jr. | 72/409 |
| 5,118,024 | 6/1992 | McClure | 228/44.5 |
| 5,209,143 | 5/1993 | Sweet | 81/9.3 |
| 5,226,231 | 7/1993 | De Lee Beeck | 29/237 |
| 5,277,089 | 1/1994 | McGushion | 81/487 |

*Primary Examiner*—D. S. Meislin
*Attorney, Agent, or Firm*—John C. Smith

[57] ABSTRACT

A plier-like tool for joining flexible hosing with hose connection nipples and hose compression rings. The tool has cutouts in the jaws which allow the flexible hose to pass through. The portion of the jaws adjacent to the cutouts form a pocket structure which surrounds the compression rings on the flexible hose. When the jaws are closed, the compression rings are held in place by the pocket structure while they are pressed onto the sections of flexible hose which are joined by a hose connection nipple. The tool has an optional hose cutter for trimming the hose and optional nipple pushers for insertion of the nipples into the flexible hose.

10 Claims, 16 Drawing Sheets

Prior Art

Prior Art

Prior Art

Prior Art

FLEXIBLE HOSE JOINING TOOL

BACKGROUND OF THE INVENTION

1. Technical Field

The present invention relates to tools. In particular, it relates to specialized pliers for repairing and/or joining segments of fluid carrying hoses located above and below ground level and methods for using the tools.

2. Background Art

Flexible hosing is used for a variety of applications and for many types of fluids. A principle advantage of this type of conduit is its low cost and ease of use. Typically, sections of hosing can be mated together to provide desired lengths and configurations.

Methods used to join flexible hoses together often rely on nipple structures to which sections of flexible hose are attached. A variety of methods are used to secure the nipples to the hosing. Where suitable, bonding techniques can be used. More often however, mechanical clamping or pressure devices are used.

One form of clamping device commonly used are wire ring hose clamps. A nipple is inserted into a section of hose and the wire ring hose clamp is spread apart by a pair of pliers, slid over the expanded section of hose which covers the nipple and then released.

A second known type of clamping devices is the compression ring. A compression ring is mounted on the flexible hosing prior to insertion of the nipple. After the nipple is inserted, the compression ring is forced over the section of hose which surrounds the nipple. While the compression ring may slide freely over unexpanded sections of hosing, the section of hose which surrounds the nipple is typically expanded by the nipple to a diameter which prevents movement of the compression ring. When the compression ring is forced over the expanded section of hose, it provides enough pressure to prevent the nipple from disengaging the hose and also to prevent leakage of fluid at the hose/nipple joint.

Typical methods of moving the compression ring into place involve the use of common tools such as a pliers to force the ring over the expanded hose section. There are several problems associated with this approach. For example, the pliers are prone to slip off the compression ring. In addition, inability to provide equal pressure on both sides of the hose tends to skew the compression ring, thereby causing the installer to use a step approach involving small moves of the compression ring on alternating sides of the hose. While it would be preferable to slide the compression ring over the expanded section of hose, it is impossible to do this with a common pliers.

While the aforedescribed problems are a nuisance for most applications which use compression rings, there are some applications in which the inability to conveniently attach compression rings is particularly undesirable. Installation of underground hoses for applications such as sprinkler systems is one such application.

A particular problem associated with underground systems is the difficulty in reaching sections of hose which may need to be repaired. For example, in applications such as golf course irrigation systems, water hoses may be run at sufficient depths below the ground surface that the repair of hose sections and installation of new nipple joints may be significantly impaired by the use of conventional tools such as pliers. Due to the depth of the hose, slippage of the pliers may cause excessive time to be used to repair a hose.

Likewise, the use of common pliers may increase the difficulty involved with insertion of the nipples into the hose.

While addressing the various aspects of hose joining, the prior art has not provided a quick, convenient method of attaching compression rings to two sections of hose. In particular, prior art attempts have failed to address problems associated with hose joining in hard to reach places such as underground hose systems used in environments such as golf course sprinkler systems.

SUMMARY OF THE INVENTION

The present invention solves the foregoing problems by providing a device which engages compression rings on both sides of the ring. This allows the ring to be inserted onto the expanded section of hose in a single procedure. In addition, the device uses a jaw structure which has cutouts on the opposing jaws which allow the hose to fit between finger-like projections on either side of the cutouts. The jaws are shaped to provide a pocket structure which surrounds the compression rings such that the device cannot slip off the ring. An optional cutter is integrated into the device along with optional nipple pushers which allow the entire repair operation to be performed with a single tool.

BRIEF DESCRIPTION OF THE DRAWINGS

FIG. 1 is a diagram of a prior art hose connection nipple.

FIG. 10 shows alternative embodiments of the jaws.

FIG. 13 shows an alternative embodiment of the invention.

FIG. 14 shows another alternative embodiment of the invention.

FIG. 16A shows a left side view of the invention. FIG. 16B shows a right side view of the invention.

DESCRIPTION OF THE PREFERRED EMBODIMENT

Figure 1A:
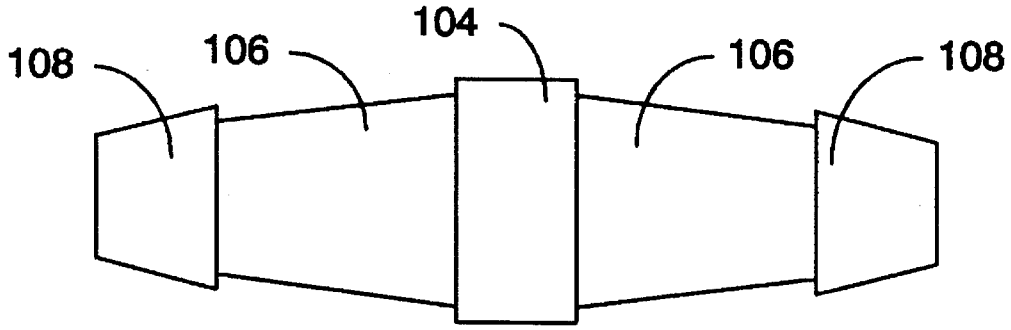
FIG. 1A is a side view.
Figure 1B:
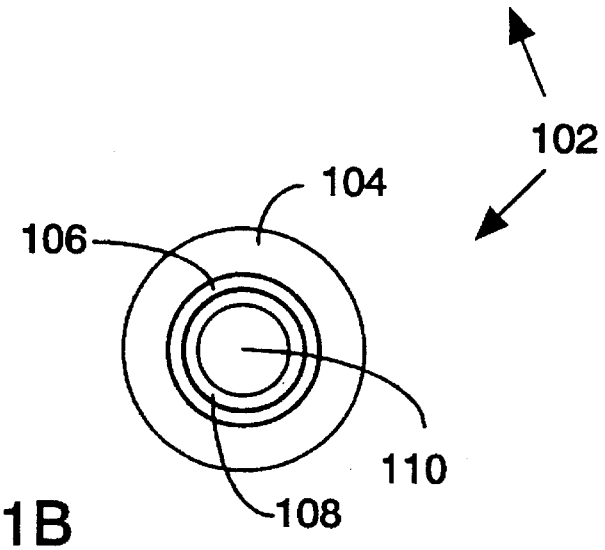
FIG. 1B is an end view.
Figure 1C:
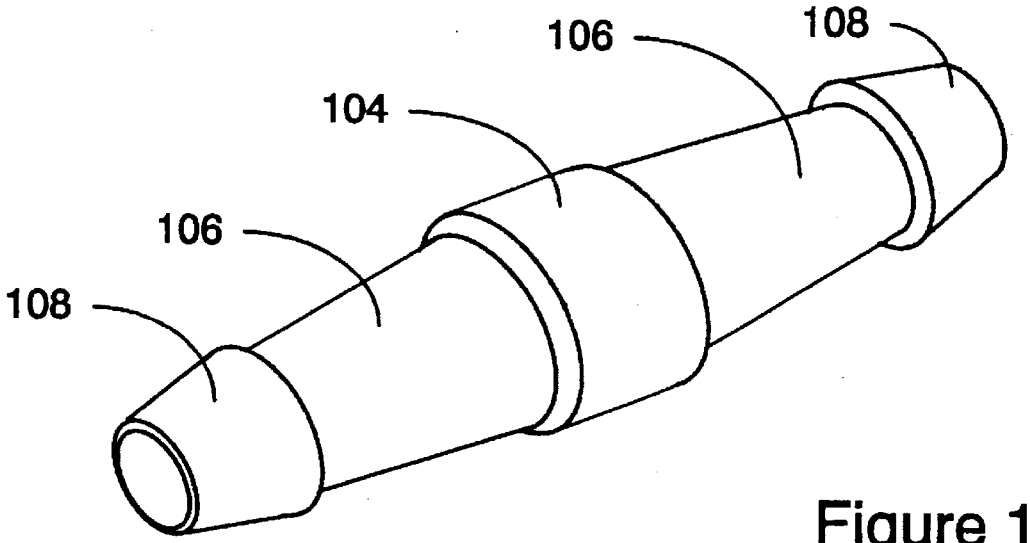
FIG. 1C is a perspective view.

FIG. 1 shows a prior art hose connection nipple 102. Flange 108 and stem 106 are inserted into a hose (not shown) and pressed into the hose until ridge 104 comes to rest against the edge of the hose. A second hose is inserted onto flange 108 and stem 106 at the other end of nipple 102. Conduit 110 extends through nipple 102 allowing free flow of fluid through nipple 102 after the hoses are connected.

Figure 2:
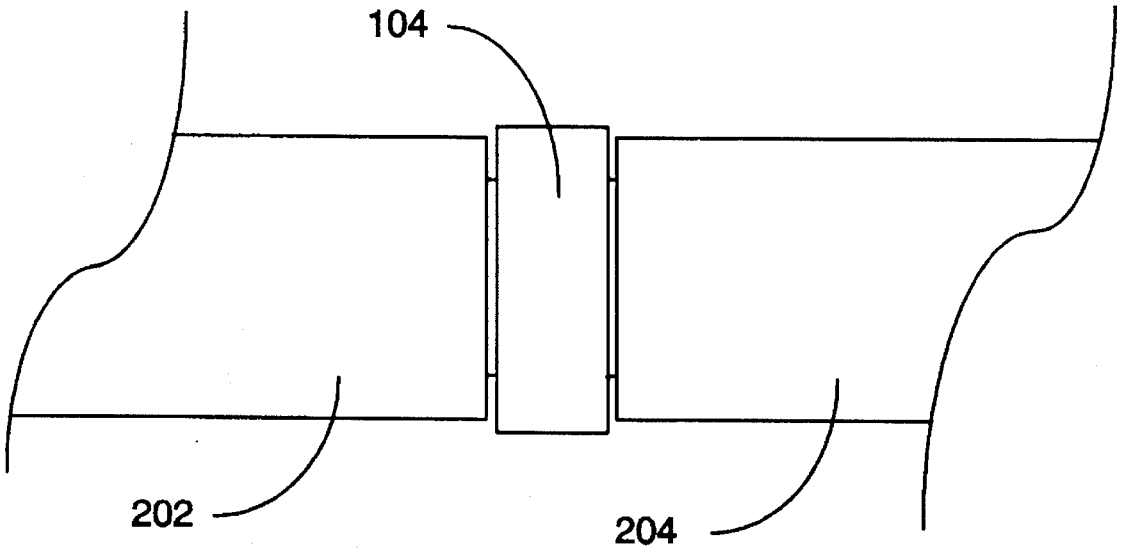
FIG. 2 is a diagram of a prior art hose connection nipple inserted into two sections of hose.

FIG. 2 shows prior art hose segments 202, 204 installed onto nipple 102. Ridge 104 is shown with hoses 202, 204 resting against either side.

Figure 3:
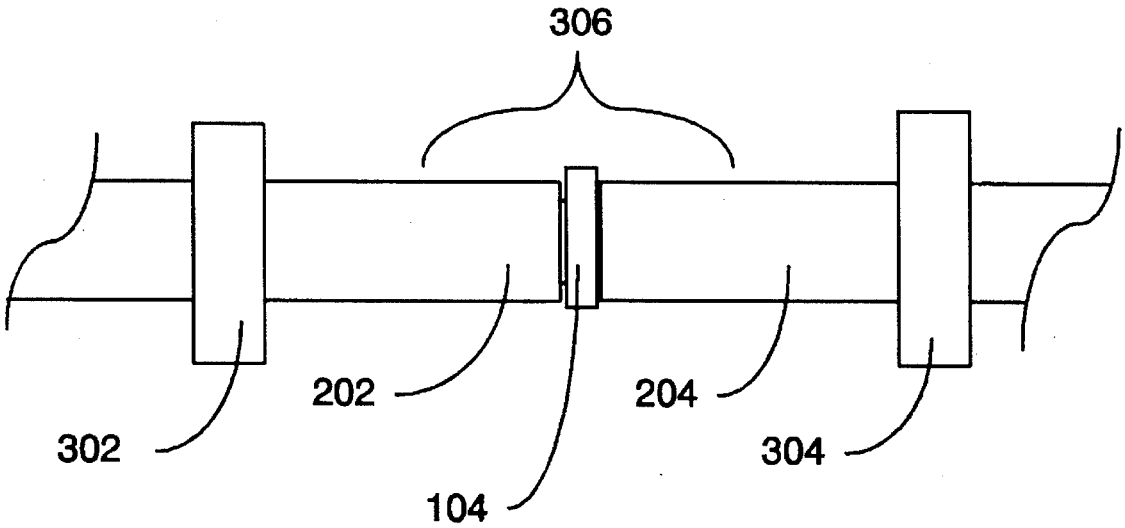
FIG. 3 a diagram of a prior art hose connection nipple inserted into two sections of hose with compression rings located beyond the expanded hose section.

FIG. 3 illustrates the location of prior art compression rings 302, 304 prior to placement of hoses 202, 204 on the expanded section 306 of hoses 302, 304 above nipple 102.

Figure 4:
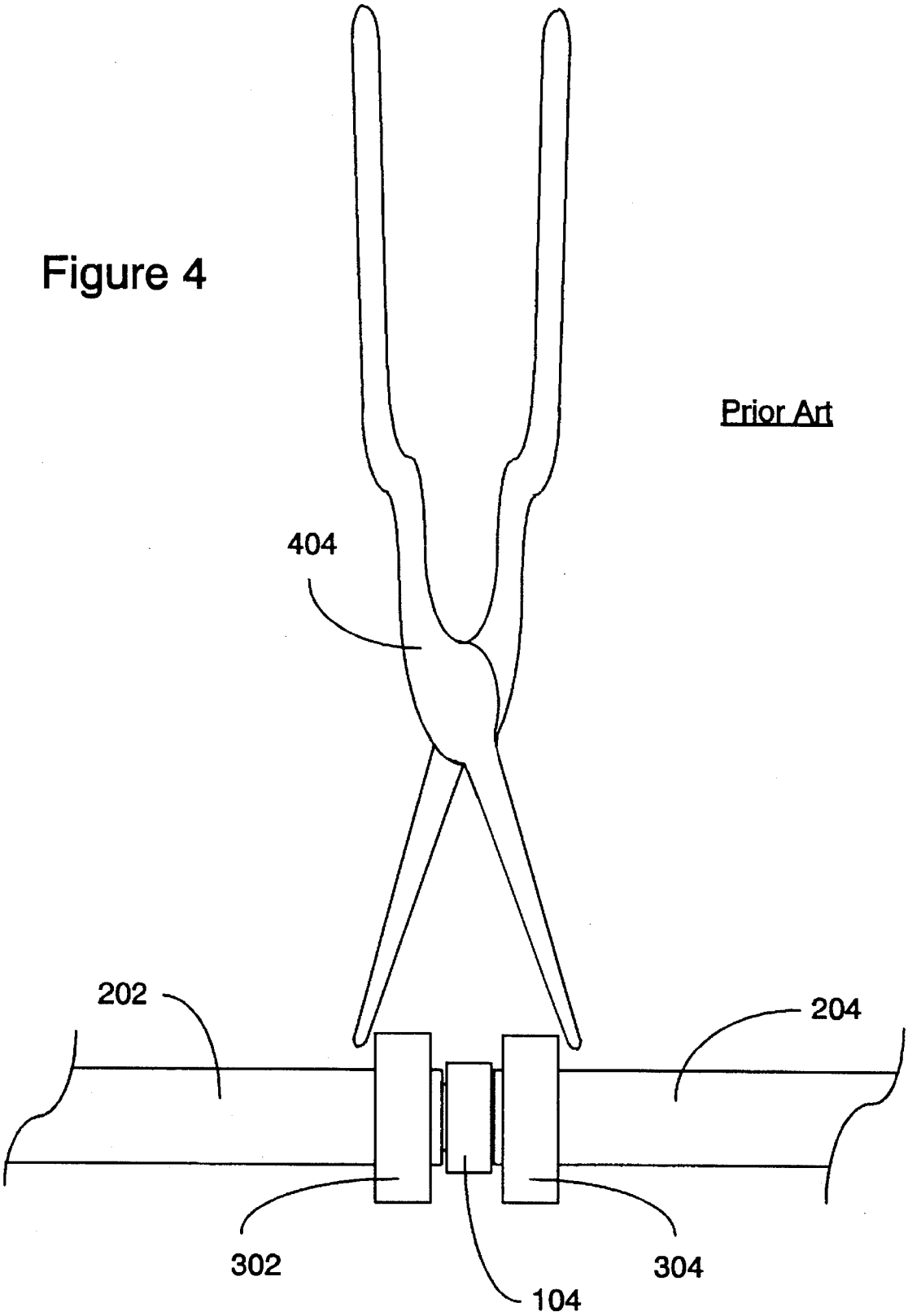
FIG. 4 is a diagram of a prior art method of moving the compression rings onto the expanded section of hose.

FIG. 4 illustrates the prior art method of installation of compression rings 302, 304 using common pliers 402. As can be seen, this method causes skewing of the compression rings, which in turn requires additional time and maneuvering of pliers 402. As can be seen, this results in a tedious series of repetitive maneuvers to get the compression rings 302, 304 into place. While this amounts to no more than a time wasting nuisance in many applications, the installation of compression rings 302, 304 on hoses 202, 204 in underground systems may be difficult and require extensive digging to provide room to maneuver. Further, the need to manipulate several components at the same time creates an awkward situation for the installer which may result in errors, faulty installations and the inadvertent dropping of parts.

Figure 5:
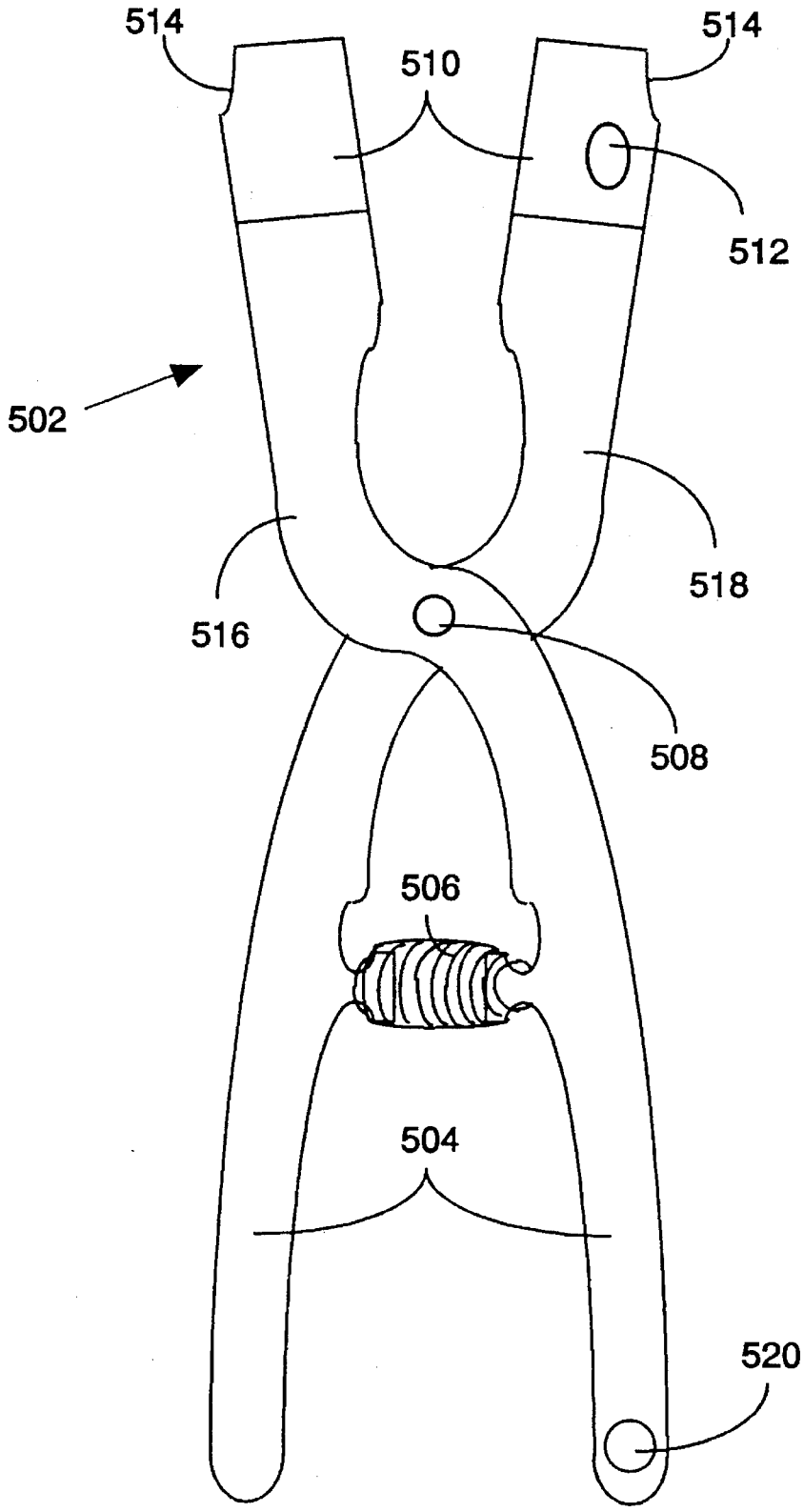
FIG. 5 shows a front view of the invention with optional nipple pushers in the jaws and the handle. A handle spring is shown connecting the handles.

FIG. 5 shows a front view of the compression ring tool 502. Opposing members 516, 518 are pivotally attached at pivot 508. Handles 504 are pushed apart by spring 506 such that the device is normally in the open position. For ease of illustration, handles 504 are not shown with any covering. However, those skilled in the art will recognize that a variety of materials can and would be used to cover the handles 504 for the purpose of increasing user comfort, providing a better grip, etc.

At the opposite end of compression ring tool 502 from handles 504 are jaws 510. On the side edges of jaws 510 are cutouts 514. Cutouts 514 are sized to fit commonly available hose 202, 204 sizes such that the hose 202, 204 can slide freely in the cutout. As can be seen, cutouts 514 oppose one another to facilitate ease of movement of hoses 202, 204. Nipple pushers 512, 520 are shown on jaws 510 and handle 504 respectively. By placing nipple pushers 512, 520 on compression ring tool 502, the nipple 102 may be installed in hose 202, 204 with the same tool that installs compression rings 302, 304, thereby enhancing ease of use and reducing the time required to effect repairs.

Those skilled in the art will recognize that a variety of alternative pivot arrangements may be used, such as rivets, nuts and bolts, etc. Likewise, the location of nipple pushers 512, 520 can vary, and they may in fact be located in any convenient location. The size of the aperture used by nipple pusher 512, 520 is not critical and will vary depending on the size of the nipple 102 intended for use with a particular hose size. Of course, a variety of nipple pusher 512, 520 sizes may be used on a single compression ring tool 502 to allow the same tool to be used for multiple sizes of nipples and hoses. Cutout 514 sizes will also vary to suit particular hose 202, 204 sizes, etc.

Figure 6:
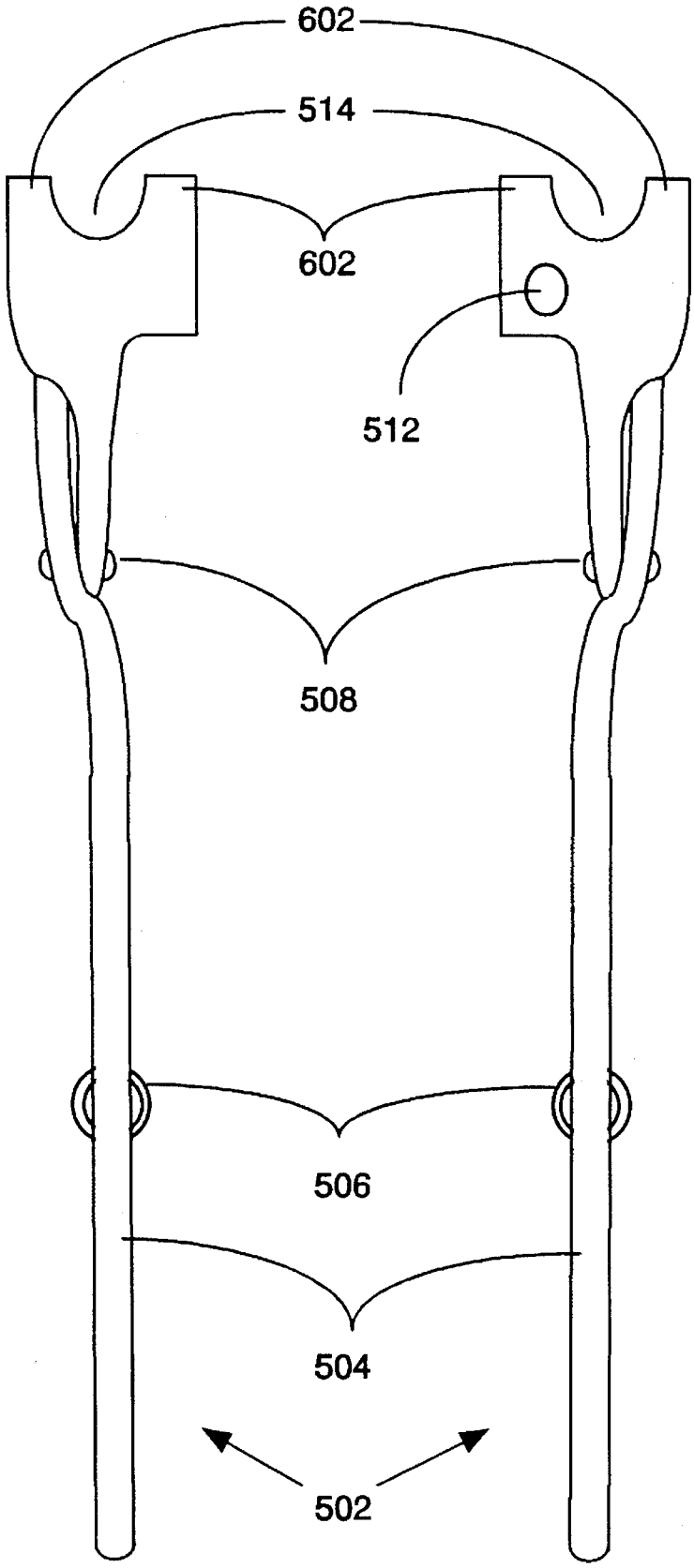
FIG. 6A shows a left side view of the invention.
FIG. 6B shows a right side view of the invention with optional nipple pusher in the jaws.

FIG. 6 shows a left and right side view of compression ring tool 502. Cutouts 514 result in the formation of fingers 602 which extend upward on either side of cutout 514. As a result, hoses 202, 204 are held securely by compression ring tool 502 without risk of slippage. A significant advantage of this structure is the elimination of the slippage problem caused by the use of common pliers for the installation of compression rings 302, 304.

Figure 7:
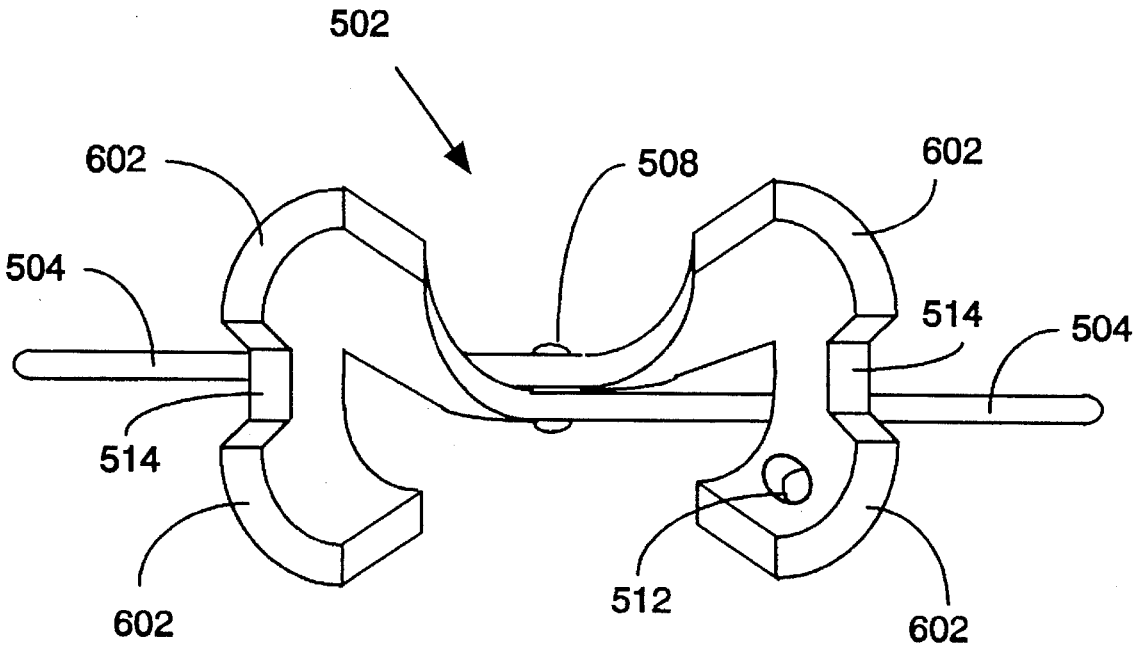
FIG. 7 shows a top view of the invention with the jaws in the open position.

FIG. 7 is a more detailed top view of compression ring tool 502 in the open position. As can be more readily seen in this view, fingers 602 form a pocket which encloses compression rings 302, 304 to prevent slippage. In addition, the pocket structure simultaneously applies pressure to both sides of compression rings 302, 304, thereby avoiding any problems caused by skewing.

Figure 8:
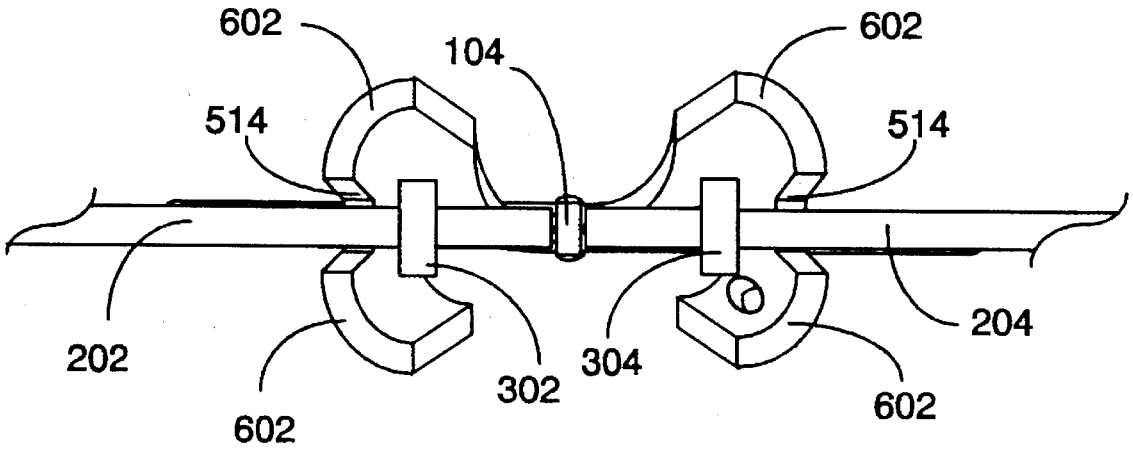
FIG. 8 shows a top view of the invention with the jaws in the open position and a hose resting in the pocket of the jaws.

FIG. 8 shows the top view of compression ring tool 502 in the open position as was discussed above in regard to FIG. 7. However, in this figure hoses 202, 204 and nipple 102 are shown mounted in cutouts 514. As can readily be seen, the hose 202, 204 and nipple 102 are held in place in the pocket formed by fingers 602.

Figure 9:
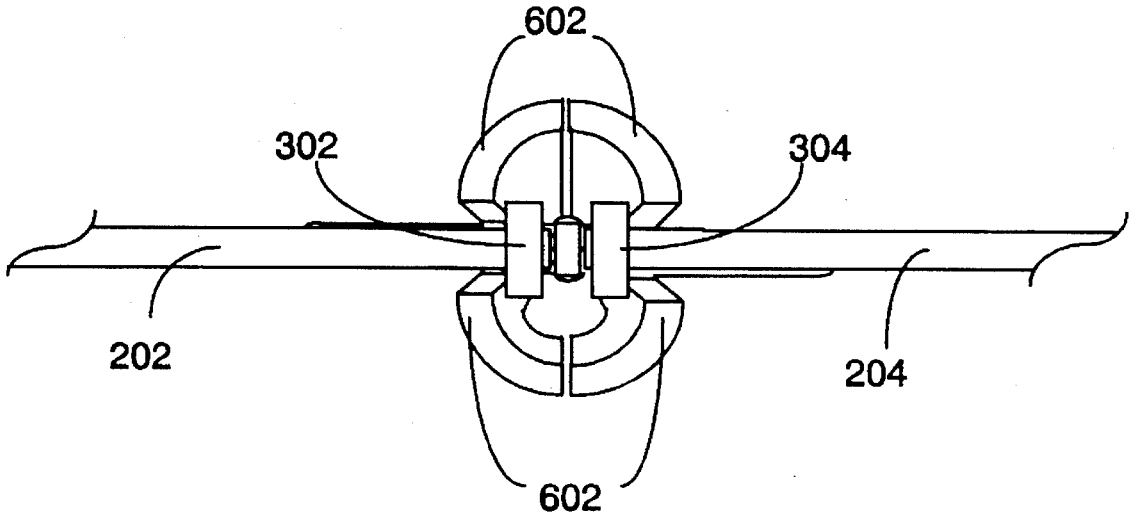
FIG. 9 shows a top view of the invention with the jaws in the closed position and a hose resting in the pocket of the jaws.
Figure 10A:
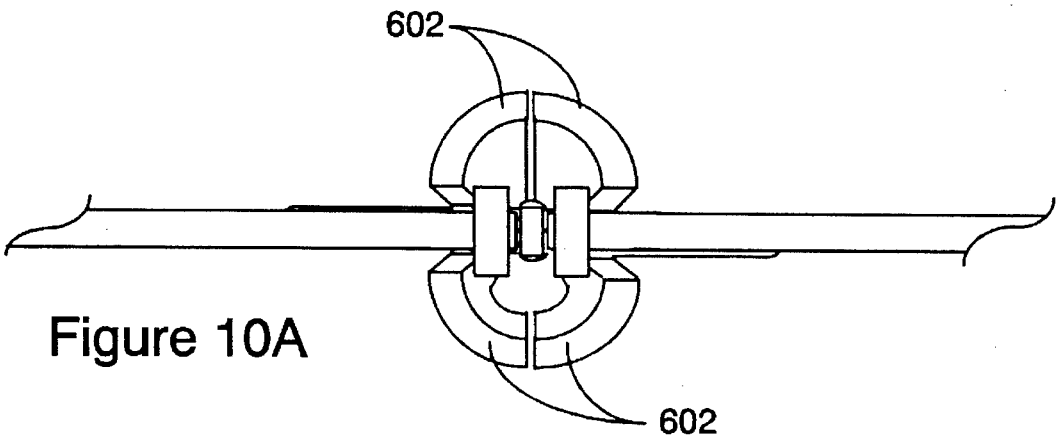
FIG. 10A shows a circular pocket.
Figure 10B:
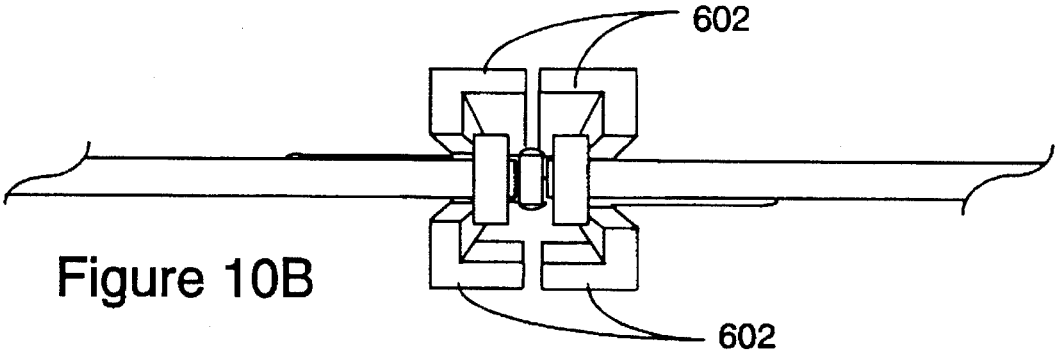
FIG. 10B shows a square pocket.
Figure 10C:
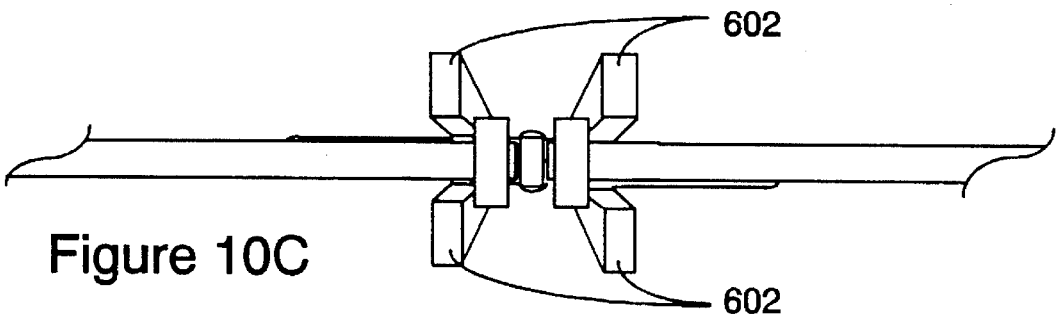
FIG. 10C shows a flat open-sided pocket.
Figure 10D:
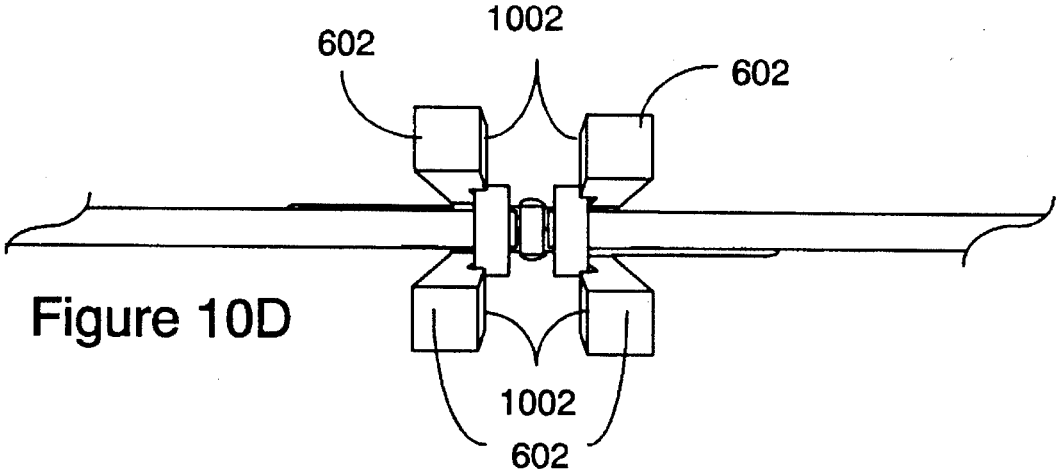
FIG. 10D shows a flat open-sided pocket with distal retainers.

FIG. 9 shows compression ring tool 502 in the closed position. The diameters of compression rings 302, 304 are larger than the distance between fingers 602. Therefore, fingers 602 force compression rings 302, 304 toward ridge 104 which in turn moves compression rings 302, 304 over the section of hose 202, 204 which is expanded by nipple 102. The effect of the fingers 602 which form a pocket around compression rings 302, 304 is to provide successful installation of compression rings 302, 304 without risk of slippage in difficult to reach locations.

FIG. 10 shows several alternative embodiments of jaws 510, each having different shapes for fingers 602. FIG. 10A shows the embodiment discussed above in regard to FIG. 9. FIG. 10B shows an embodiment in which fingers 602 have a rectangular configuration. FIG. 10C uses a flat, open sided configuration. In FIG. 10D, fingers 602 have extension 1002 which extend over the edge of compression ring 302, 304. As these figure indicate, the particular shape of the pocket is of no concern so long as the pocket captures compression ring 302, 304, thereby allowing it to install compression rings 302, 304 without slippage and in a single procedure.

Figure 11:
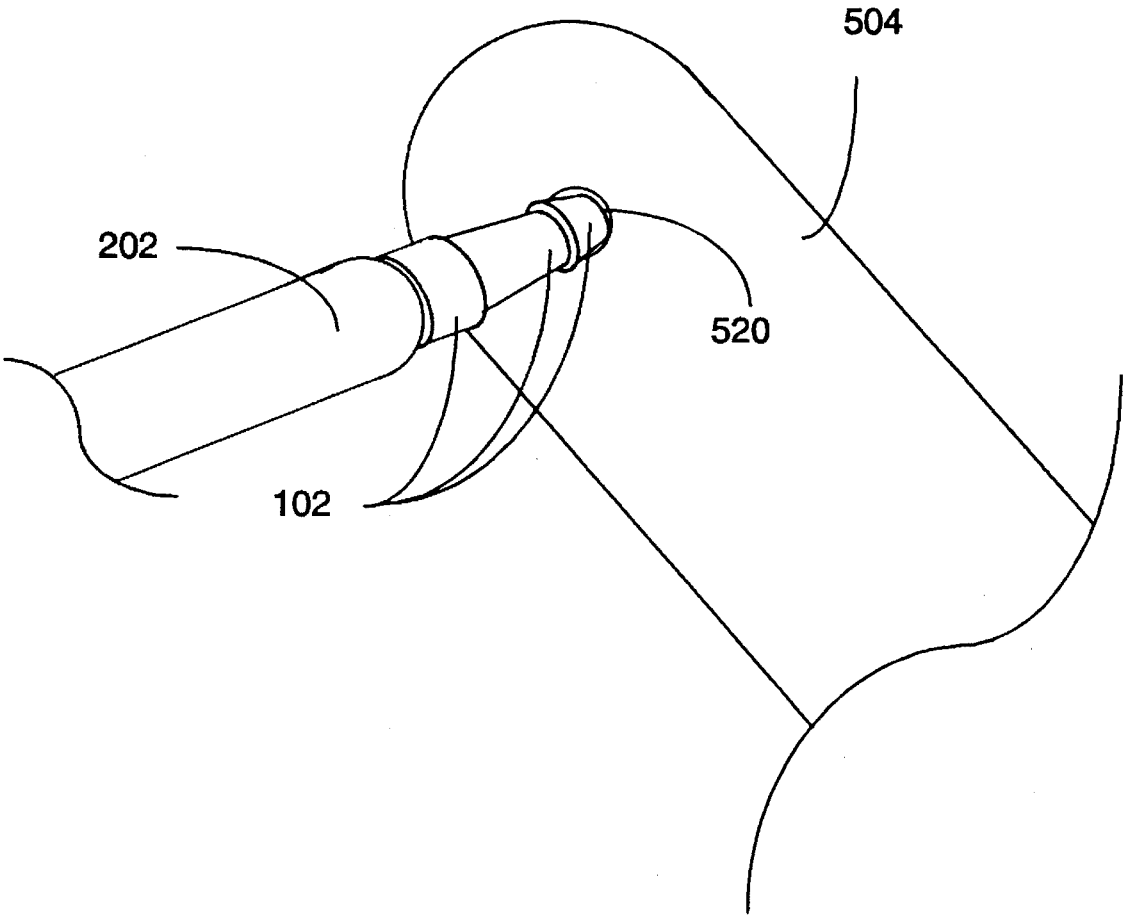
FIG. 11 shows a perspective view of the handle with optional nipple pusher pushing a nipple into a section of hose.

FIG. 11 shows a nipple 102 being installed in hose 202. The end of nipple 102 opposite hose 202 is inserted in nipple pusher 520. Handle 504 is then used to hold nipple 102 and to apply pressure to force it into hose 202. The selection of which nipple pusher 512, 520 to use would be one of convenience. As noted above, a variety of sizes of nipple pushers 512, 520 can be used on a single compression ring tool 502.

Figure 12:
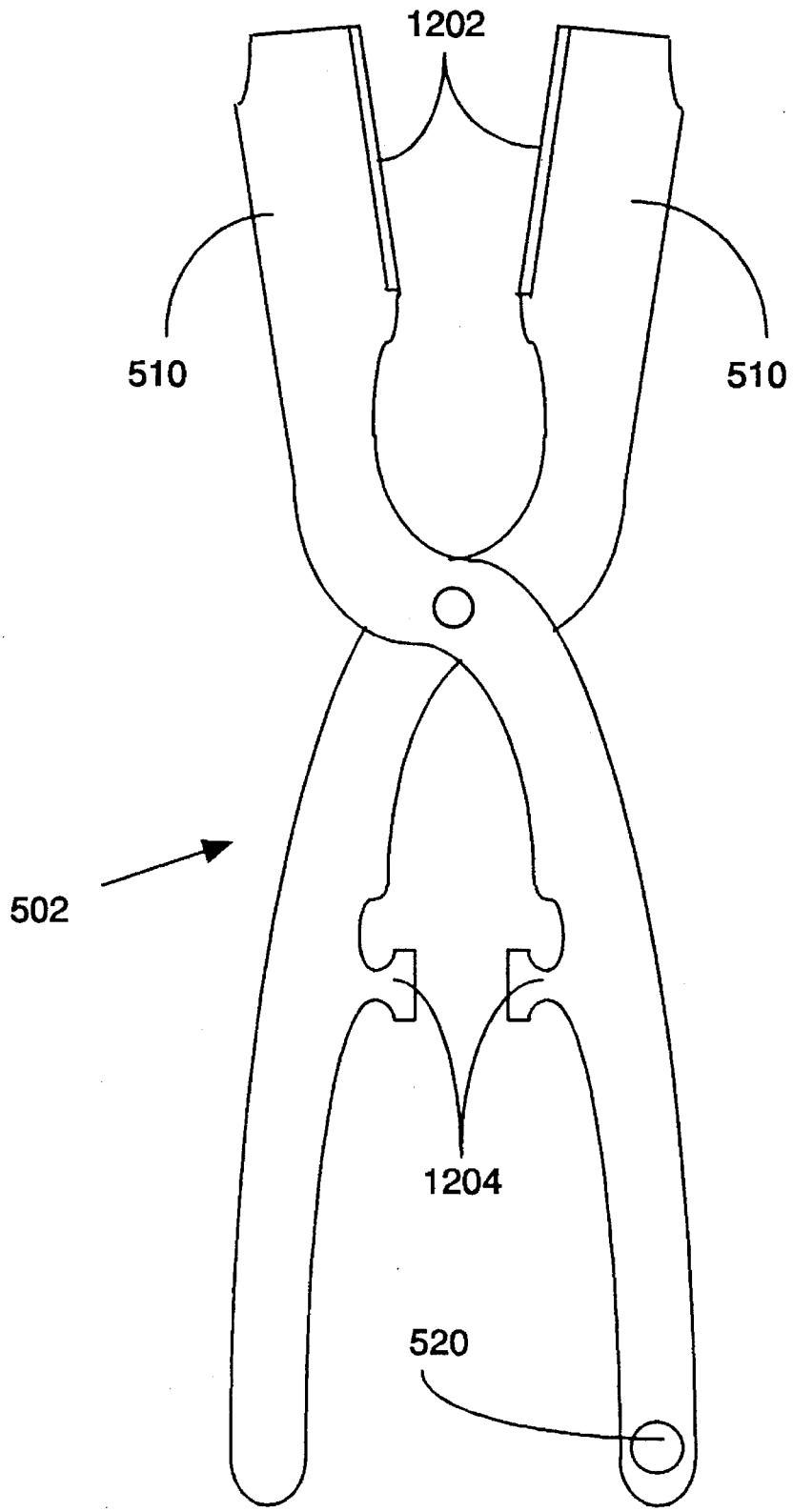
FIG. 12 shows a rear view of the invention with optional cutter on the rear edge of the jaws. The handle spring is not shown.

FIG. 12 shows a rear view of compression ring tool 502. In this embodiment, spring 506 is not shown to illustrate spring retainers 1204. On the inside edge of jaws 510 are cutting edges 1202. The addition of these optional cutting edges allows the single tool to effect all require repair operations. Damages sections of hose 202, 204 can be cut out by cutting edge 1202, a new nipple 102 can be inserted by nipple pusher 520, and compression rings 302, 304 can be installed by closing jaws 510 while the compression rings 302, 304 are inside the pocket formed by jaws 510.

Figure 13A:
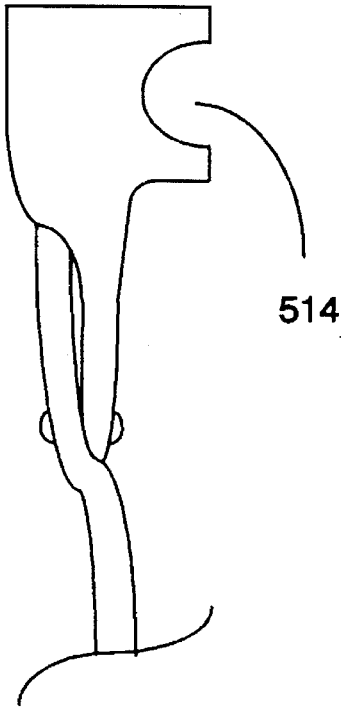
FIG. 13A shows a left side view of the invention.
Figure 13B:
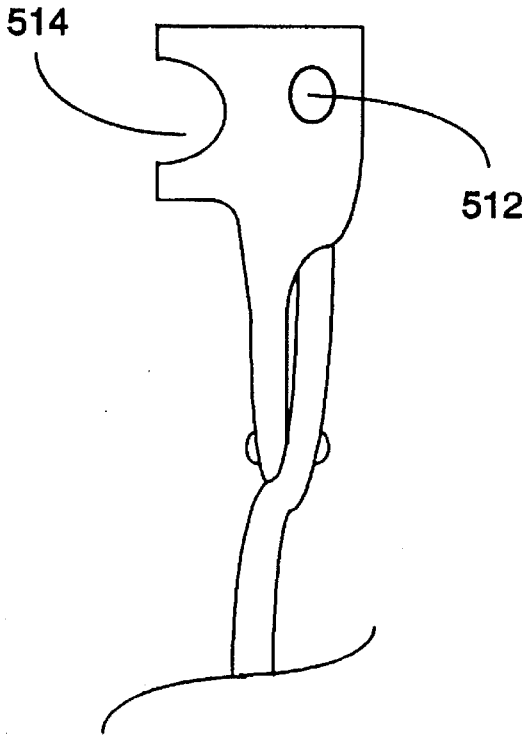
FIG. 13B shows a right side view of the invention with optional nipple pusher in the jaws.
Figure 13C:
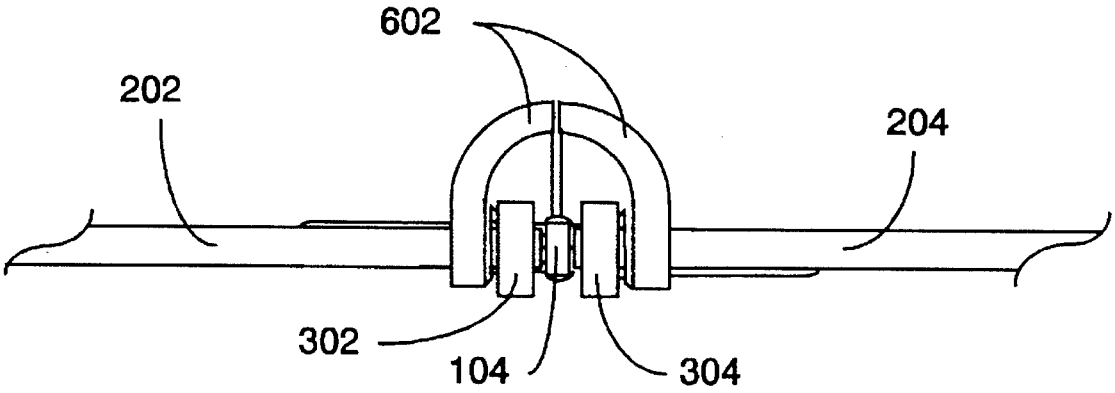
FIG. 13C shows a top view of the invention.

FIG. 13 shows an alternative embodiment in which the cutouts are on the side of the jaws rather than on the distal end. FIGS. 13A and 13B provide left and right side views respectively. FIG. 13C is a top view which shows the formation of the pocket from the side. The advantage of this configuration is that it provides an alternative method of forming the pocket.

Figure 14A:
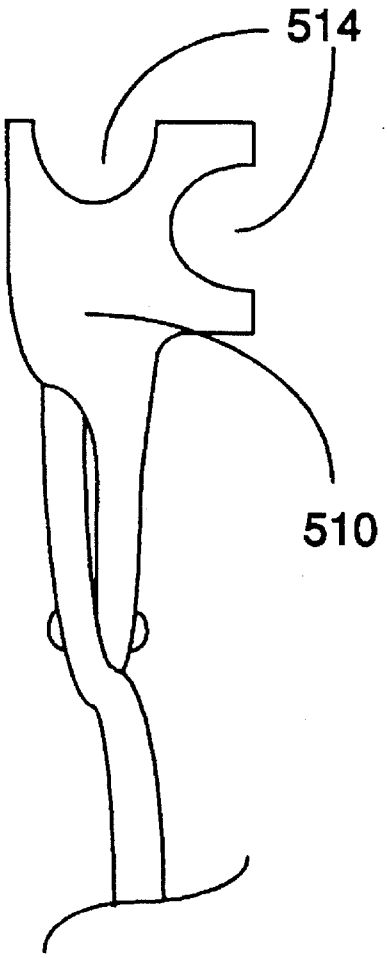
FIG. 14A shows a left side view of the invention.
Figure 14B:
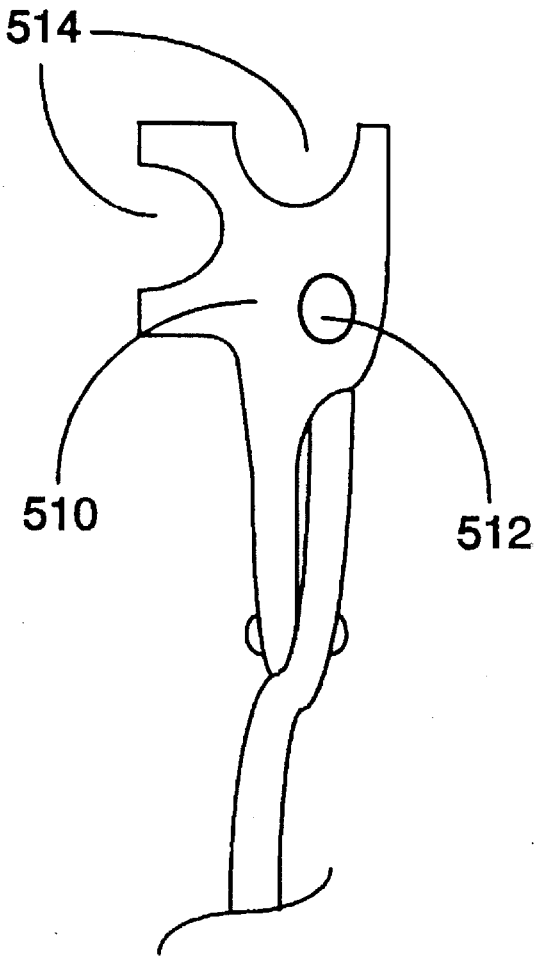
FIG. 14B shows a right side view of the invention with optional nipple pusher in the jaws.

FIG. 14 is another embodiment which provides cutouts on the distal end and on the sides of jaws 510. The advantage of this embodiment is that it provides more flexibility to the user when the hose 202, 204 is in a difficult to reach location.

Figure 15:
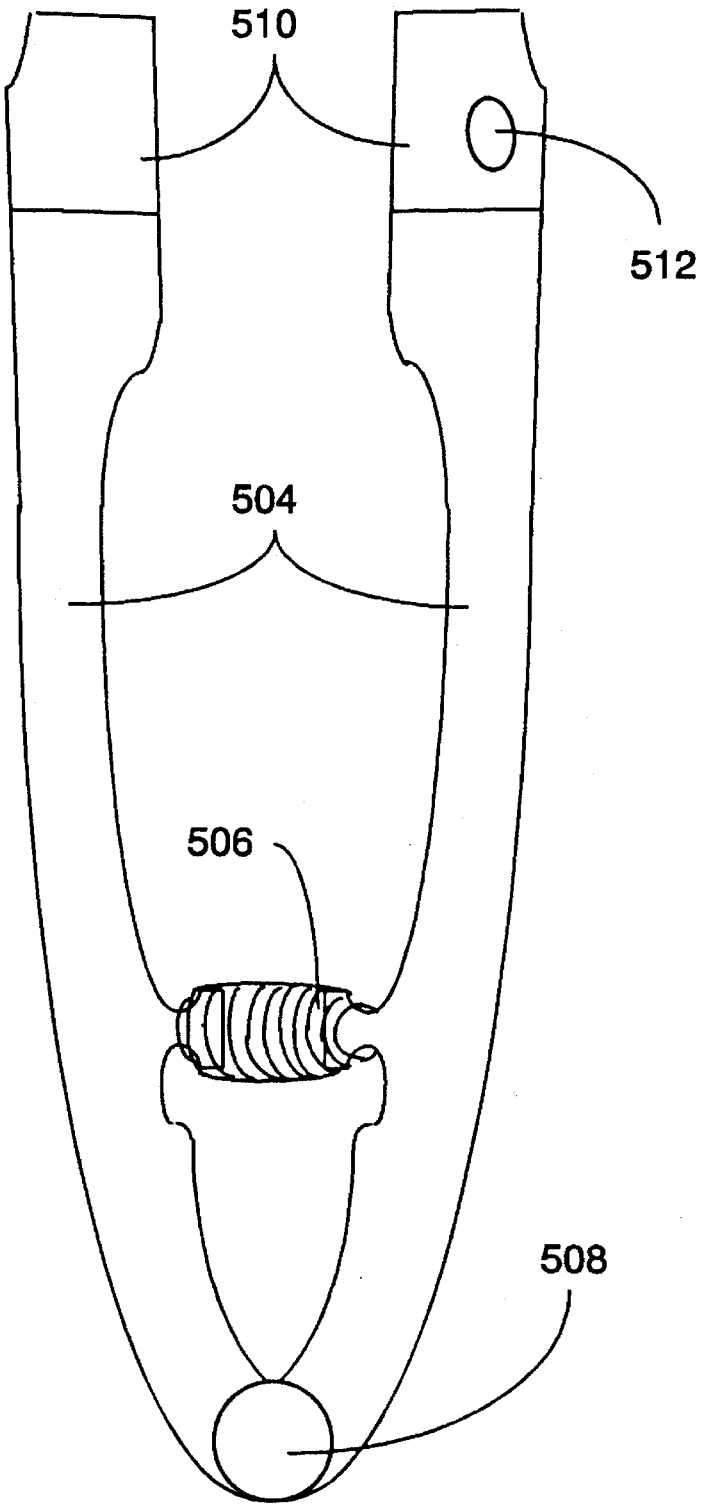
FIG. 15 another alternative embodiment of the invention with the pivot point located at the proximal end of the device.

FIG. 15 is another alternative embodiment in which the pivot 508 is located at the proximal end of compression ring tool 502. Handles 504 are in the middle of the device and jaws 510 are at the opposite end from the pivot 508.

Figure 16:
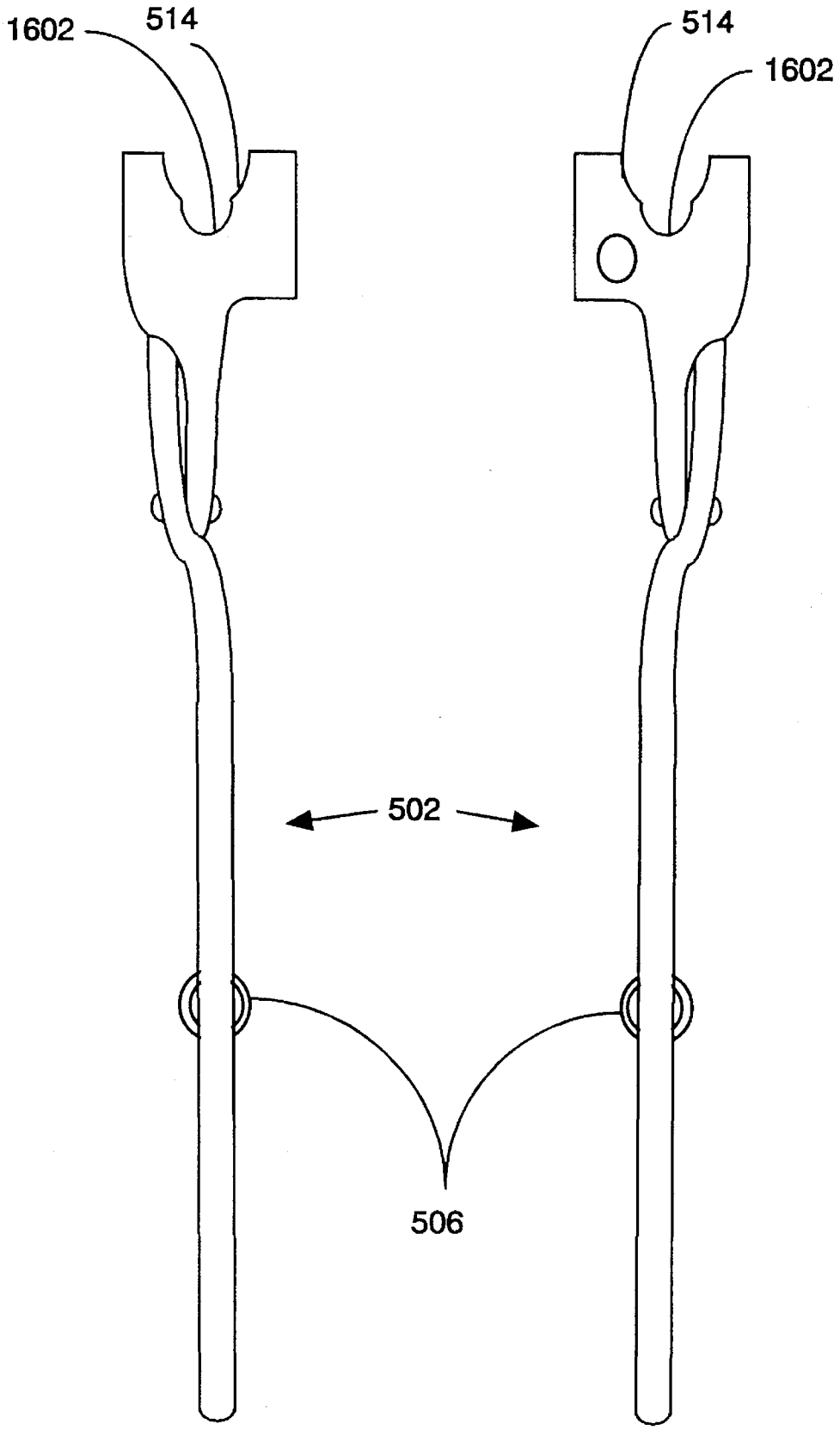
FIG. 16 shows another alternative embodiment of the invention with multiple cutout sizes for multiple hose sizes.

FIG. 16 is another alternative embodiment in which multiple size cutouts 514, 1602 are used. This allows the same compression ring tool 502 to be used for a variety of hose 202, 204 sizes.

While the invention has been described with respect to a preferred embodiment thereof, it will be understood by those skilled in the art that various changes in detail may be made therein without departing from the spirit, scope, and teaching of the invention. For example, the number and size of nipple pushers can vary, the number and size of cutouts can vary, the location of the cutouts can vary, etc. Accordingly, the invention herein disclosed is to be limited only as specified in the following claims.

I claim:

1. A tool for joining flexible hosing, comprising:

pivot means;

first and second opposing members, each opposing member further comprising;

handle means;

jaw means, the jaw means having a first cutout in one edge of the distal end of the jaw means and located such that the jaw means forms a finger section on each side of the first cutout; and means to attach to the pivot means; and first nipple pushing means, the first nipple pushing means having an aperture for holding hose connection nipples; and the first and second opposing members pivotally attached to the pivot means such that the jaw means can move between an open and a closed position, the first and second opposing members further attached to the pivot means such that the first cutout on the first opposing member's jaw means is substantially aligned with the first cutout on the second opposing member's jaw means when the jaw means are closed, the fingers on the jaw means of the first and second opposing members forming a pocket when the jaw means are closed.

2. A tool, as in claim 1, further comprising:

cutting means, the cutting means further having a first cutting edge located on a side edge of the jaw means on the first opposing cutter and a second cutting edge located on a side edge of the jaw means on the second opposing cutter, the first and second cutting edges aligned such that the first and second cutting edges close together when the jaw means are closed.

3. A tool, as in claim 2, wherein the first nipple pushing means is located in the jaw means.

4. A tool, as in claim 2, wherein the first nipple pushing means is located in the handle means.

5. A tool, as in claim 4, further comprising a second nipple pushing means wherein the first and second nipple pushing means are located in the jaw means and the handle means respectively.

6. A tool for joining flexible hosing, comprising:

pivot means;

first and second opposing members, each opposing member further comprising:

handle means;

jaw means, the jaw means having a first cutout located on a side edge of the jaw means such that the jaw means forms a finger section on each side of the first cutout; and means to attach to the pivot means;

first nipple pushing means, the first nipple pushing means having an aperture for holding hose connection nipples; and the first and second opposing members pivotally attached to the pivot means such that the jaw means can move between an open and a closed position, the first and second opposing members further attached to the pivot means such that the first cutout on the first opposing member's jaw means is substantially aligned with the first cutout on the second opposing member's jaw means when the jaw means are closed, the fingers on the jaw means of the first and second opposing members forming a pocket when the jaw means are closed.

7. A tool, as in claim 6, further comprising:

cutting means, the cutting means further having a first cutting edge located on a side edge of the jaw means on the first opposing cutter and a second cutting edge located on a side edge of the jaw means on the second opposing cutter, the first and second cutting edges aligned such that the first and second cutting edges close together when the jaw means are closed.

8. A tool, as in claim 7, wherein the first nipple pushing means is located in the jaw means.

9. A tool, as in claim 7, wherein the first nipple pushing means is located in the handle means.

10. A tool, as in claim 9, further comprising a second nipple pushing means wherein the first and second nipple pushing means are located in the jaw means and the handle means respectively.

* * * * *